US006510910B2

(12) United States Patent
Eyre et al.

(10) Patent No.: US 6,510,910 B2
(45) **Date of Patent: *Jan. 28, 2003**

(54) UNPLANAR NON-AXISYMMETRIC INSERTS

(75) Inventors: Ronald K. Eyre, Orem, UT (US); Stewart Middlemiss, Salt Lake City, UT (US)

(73) Assignee: Smith International, Inc., Houston, TX (US)

( * ) Notice: Subject to any disclaimer, the term of this patent is extended or adjusted under 35 U.S.C. 154(b) by 21 days.

This patent is subject to a terminal disclaimer.

(21) Appl. No.: 09/780,963

(22) Filed: Feb. 9, 2001

(65) Prior Publication Data

US 2002/0108790 A1 Aug. 15, 2002

(51) Int. Cl.[7] ..... E21B 10/46; E21B 10/52
(52) U.S. Cl. ..... 175/430; 175/428; 175/434
(58) Field of Search ..... 175/425, 426, 175/428, 430, 434

(56) References Cited

U.S. PATENT DOCUMENTS

| | | | | |
|---|---|---|---|---|
| 4,109,737 | A | 8/1978 | Bovenkerk | 175/329 |
| 4,764,434 | A | 8/1988 | Aronsson et al. | 428/565 |
| 4,784,023 | A | 11/1988 | Dennis | 76/108 A |
| 4,972,637 | A | 11/1990 | Dyer | 51/295 |
| 4,997,049 | A | 3/1991 | Tank et al. | 175/410 |
| 5,011,515 | A | 4/1991 | Frushour | 51/307 |
| 5,037,451 | A | 8/1991 | Burnand et al. | 51/293 |
| 5,217,081 | A | 6/1993 | Waldenstöm et al. | 175/420.2 |
| 5,351,772 | A | 10/1994 | Smith | 175/428 |
| 5,355,969 | A | 10/1994 | Hardy et al. | 175/432 |
| 5,379,854 | A | 1/1995 | Dennis | 175/434 |
| 5,469,927 | A | 11/1995 | Griffin | 175/432 |
| 5,484,330 | A | 1/1996 | Flood et al. | 451/540 |
| 5,486,137 | A | 1/1996 | Flood et al. | 451/540 |
| 5,494,477 | A | 2/1996 | Flood et al. | 451/540 |

(List continued on next page.)

FOREIGN PATENT DOCUMENTS

| | | |
|---|---|---|
| EP | 0687797 | 12/1995 |
| EP | 0893572 | 1/1999 |
| GB | 2270493 | 3/1994 |
| GB | 2323398 A | 9/1998 |
| GB | 2329405 | 3/1999 |
| GB | 2339221 A | 1/2000 |

*Primary Examiner*—David Bagnell
*Assistant Examiner*—Jennifer H Gay
(74) *Attorney, Agent, or Firm*—Christie, Parker & Hale, LLP

(57) ABSTRACT

Cutting elements for incorporation in a drill bit are provided having a body having an end face interfacing with an ultra hard material cutting layer. A main depression having a nonplanar surface is formed on the substrate and extending to the peripheral edge of the substrate subjected to the highest impact loads during drilling. This edge is immediately below the edge of the cutting layer which makes direct contact with the earth formations during drilling. The main depression is formed by forming a plurality of secondary depressions or steps. A second main depression is formed by forming a plurality of secondary depressions or steps. The second main depression also extends to the peripheral edge of the substrate. An ultra hard material layer is bonded to the end face of the cutting element body over the main depressions.

20 Claims, 13 Drawing Sheets

U.S. PATENT DOCUMENTS 5,544,713 A 8/1996 Dennis ..... 175/434
5,564,511 A 10/1996 Frushour ..... 175/431
5,566,779 A 10/1996 Dennis ..... 175/426
5,590,728 A 1/1997 Matthias ..... 175/432
5,592,995 A * 1/1997 Scott et al. ..... 175/374
5,598,750 A 2/1997 Griffin et al. ..... 76/108.2
5,605,199 A 2/1997 Newton ..... 175/432
5,611,649 A 3/1997 Matthias ..... 407/118
5,617,928 A 4/1997 Matthias et al. ..... 175/432
5,622,233 A 4/1997 Griffin ..... 175/432
5,662,720 A 9/1997 O'Tighearnaigh ..... 51/295
5,669,271 A 9/1997 Griffin et al. ..... 76/108.2
5,709,279 A 1/1998 Dennis ..... 175/430
5,711,702 A 1/1998 Devlin ..... 451/540
5,746,280 A * 5/1998 Scott et al. ..... 175/374
5,752,573 A * 5/1998 Scott et al. ..... 175/374
5,816,347 A 10/1998 Dennis et al. ..... 175/432
5,871,060 A 2/1999 Jensen et al. ..... 175/420.2
5,881,830 A 3/1999 Cooley ..... 175/428
5,888,619 A 3/1999 Griffin ..... 428/172
5,906,246 A 5/1999 Mensa-Wilmot et al. ... 175/432
5,971,087 A 10/1999 Chaves ..... 175/432
5,979,577 A 11/1999 Fielder ..... 175/431
6,000,483 A 12/1999 Jurewicz et al. ..... 175/428
6,011,232 A 1/2000 Matthias ..... 219/69.17
6,059,054 A * 5/2000 Portwood et al. ..... 175/430
6,065,554 A * 5/2000 Taylor et al. ..... 175/430
6,068,071 A 5/2000 Jurewicz
6,102,143 A 8/2000 Snyder et al. ..... 175/432
6,148,937 A 11/2000 Mensa-Wilmot et al. ... 175/428
6,196,340 B1 3/2001 Jensen et al. ..... 175/431
6,196,910 B1 3/2001 Johnson et al. ..... 451/540
6,199,645 B1 3/2001 Anderson et al. ..... 175/426
6,202,771 B1 3/2001 Scott et al. ..... 175/432
6,202,772 B1 3/2001 Eyre et al. ..... 175/432
6,227,318 B1 * 5/2001 Siracki ..... 175/426
6,241,035 B1 * 6/2001 Portwood ..... 175/374
6,244,365 B1 * 6/2001 Southland ..... 175/432
6,290,008 B1 * 9/2001 Portwood et al. ..... 175/420.1

* cited by examiner

UNPLANAR NON-AXISYMMETRIC INSERTS

FIELD OF THE INVENTION

This invention relates to cutting elements used in drag bit for drilling earth formations. Specifically this invention relates to cutting elements having a unplanar interface including a non-uniform portion between their substrate and their cutting layer.

BACKGROUND OF THE INVENTION

A typical cutting element is shown in FIG. 1. The cutting element typically has cylindrical cemented carbide substrate body 2 having an end face or upper surface 3. An ultra hard material layer 4, such as polycrystalline diamond or polycrystalline cubic boron nitride, is bonded on to the upper surface forming a cutting layer. The cutting layer can have a flat or a curved upper surface 5.

The problem with many cutting elements is the development of cracking, spalling, chipping and partial fracturing of the ultra hard material cutting layer at the layer's region subjected to the highest impact loads during drilling. This region is referred to herein as the "critical region". These problems are caused by the generation of peak (high magnitude) stresses imposed on the ultra hard material layer at the critical region during drilling. Because the cutting elements are typically inserted into a drag bit at a rake angle, the critical region includes a portion of the ultra hard material layer near to and including a portion of the layer's circumferential edge 6.

Another problem facing cutting elements is the delamination and/or the exfoliation of the ultra hard material layer from the substrate of the cutting element resulting in the failure of the cutter. Delamination and/or exfoliation become more prominent as the thickness of the diamond layer increases.

SUMMARY OF THE INVENTION

The present invention provides for cutting elements or inserts which are mounted in a bit body. The cutting elements have a body over which if formed an ultra hard material cutting layer. The inventive cutting elements have an increased thickness of the ultra hard material cutting layer at their critical region, i.e., the region of the cutting element subjected to the highest impact loads during drilling. This region is generally defined beginning at the edge of the cutting element which contacts the earth formations during drilling and can span up to 50% of the cross-sectional area of the cutting element. Preferably, the critical region extends to an area between 45° and 70° on either side of the point of contact of the cutting element with the earth formation and inward to an area near the central axis of the cutting element.

A main depression is formed on the body (i.e., the substrate) end face (i.e., the upper surface) of the cutting element covering the critical region. The main depression is defined by multiple secondary depressions defining a main depression surface having a depth which increases in an outward radial direction along a critical diameter and which decreases arcuately on either side of the critical diameter. The critical diameter is the diameter that intersects the point of contact between the edge of the cutting element and the earth formation. An ultra hard material layer is bonded to the end surface of the substrate and has either a curved or flat upper surface such that an increased thickness of the ultra hard material layer is formed over the critical region with the maximum ultra hard material thickness occurring at or proximate the edge portion or edge point of the cutting element making contact with the earth formations during drilling.

In alternate embodiments, more than one main depressions are formed on the substrate upper surface. In this regard, as the ultra hard material layer wears due to drilling, the cutting element can be detached, rotated and re-attached to the bit body so as to orient another main depression on the critical region of the cutting element. In this regard, the cutting element can be used again.

In one alternate embodiment, a cutting element is formed with two main depressions. In a preferred embodiment, the two main depressions are oriented such that their central longitudinal axis form an angle relative to each other that is less than 180° but greater than 170°.

In another embodiment, two main depression may used such that their central longitudinal axes are oriented at 180° to each other. In a further alternate embodiment, three main depressions are formed on the upper surface of the substrate such that their central longitudinal axes are spaced apart and oriented at 120° to each other. In further alternate embodiment, four main depressions are formed. Preferably, with this embodiment the longitudinal central axis of the four main depressions are spaced apart and oriented at 90° to each other.

Moreover, a circumferential groove is formed on the outer surface of the body of the cutting element and spans an arc that is approximately the same as the arc spanned by the critical region of the cutting element. The groove is preferably symmetric about the critical diameter of the cutting element. An ultra hard material is packed into the groove forming a secondary cutting surface for improving the cutting efficiency of the cutting element as well as delaying the erosion of the cutting element during drilling.

DETAILED DESCRIPTION OF THE INVENTION

Figure 1:
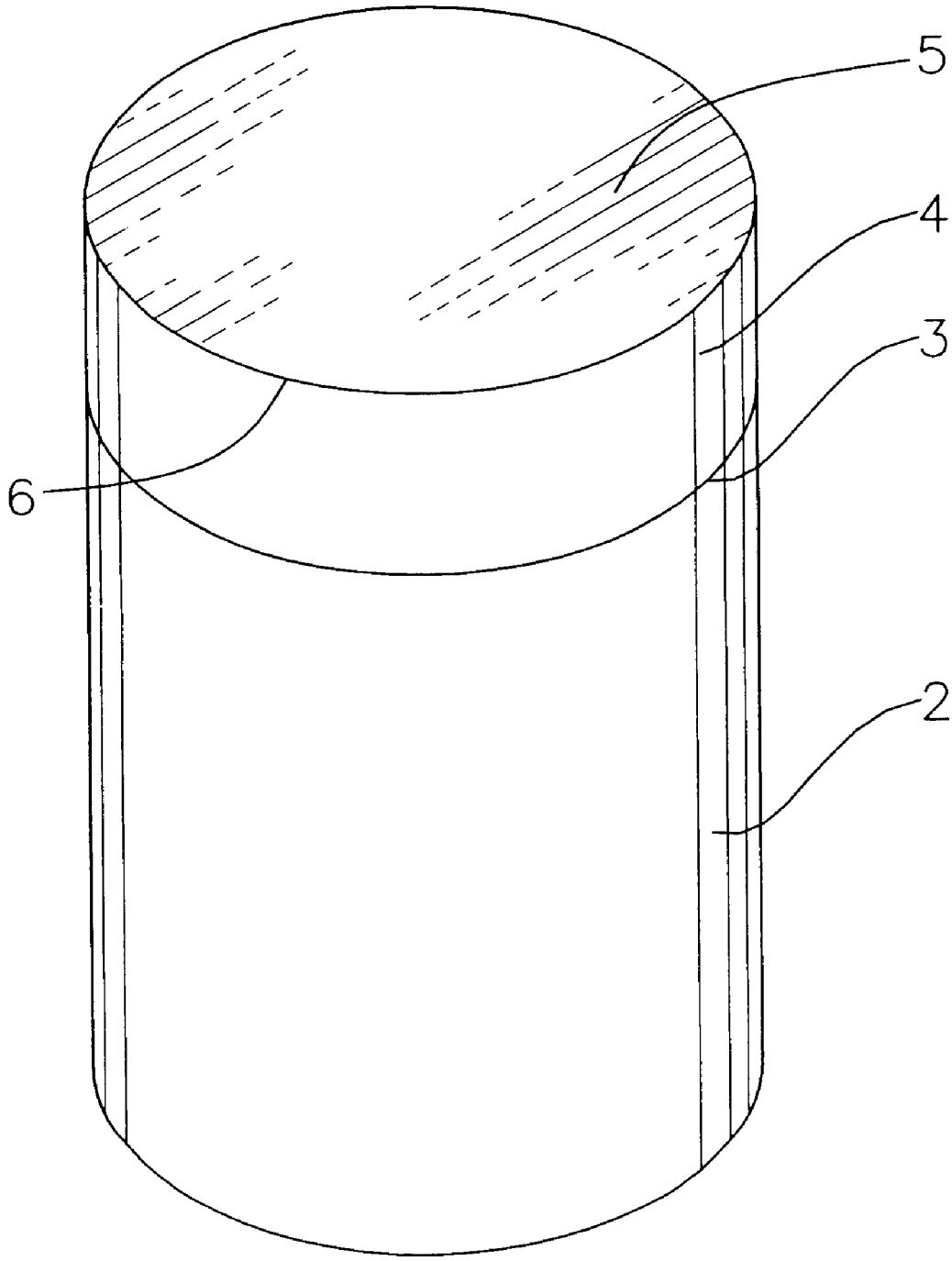
FIG. 1 PRIOR ART
FIG. 1 is a perspective view of a conventional cutting element.
Figure 2A:
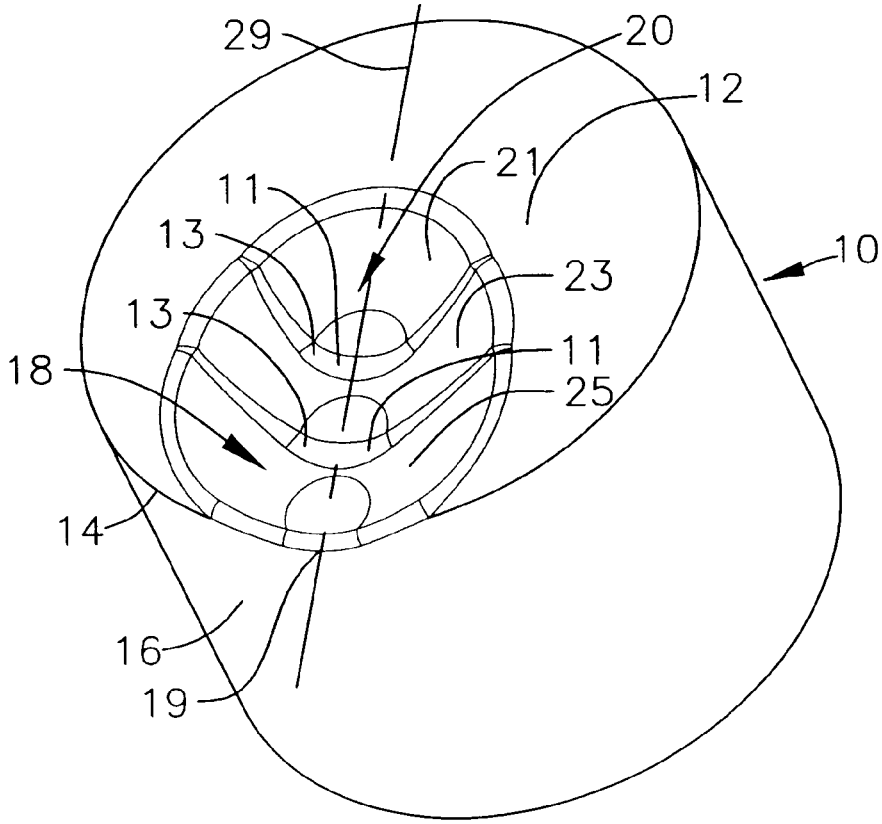
FIG. 2A is a perspective view of the body of an embodiment of an unplanar non-axisymmetric insert of the present invention.
Figure 2B:
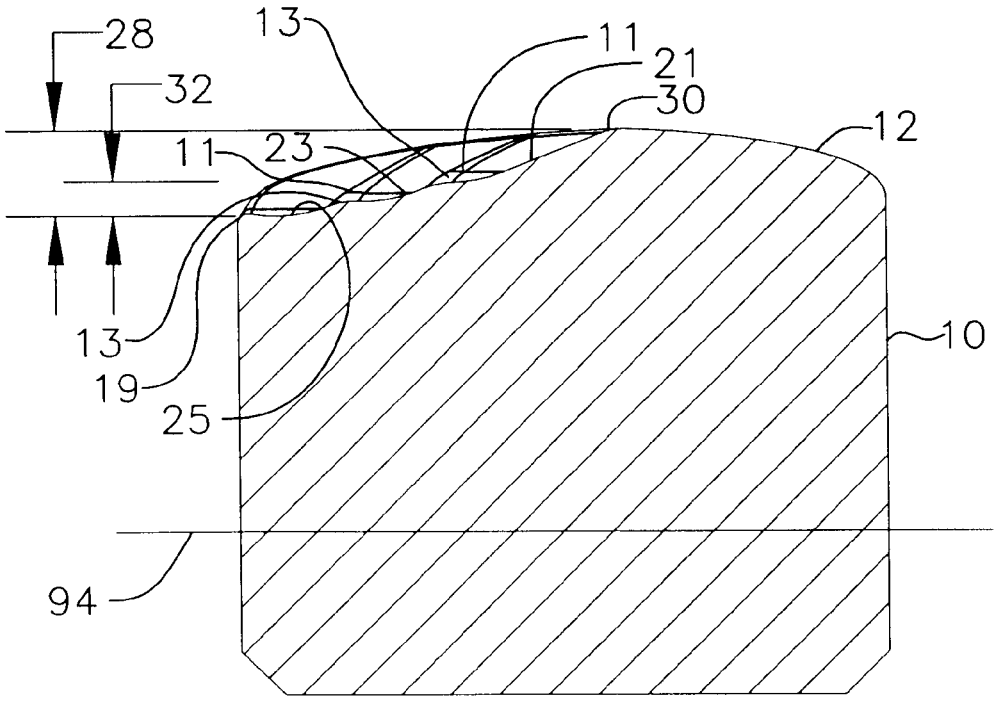
FIGS. 2B, 2C, and 2D are a cross-sectional view, a top view, and a front view, respectively of the insert body shown in FIG. 2A.
Figure 2C:
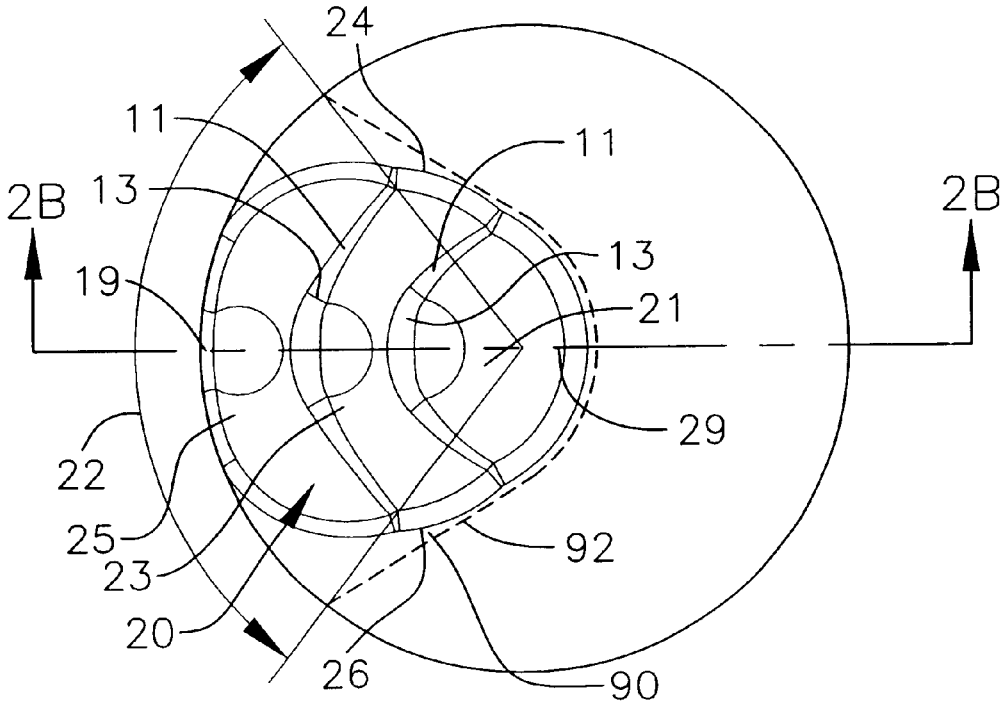
Figure 2D:
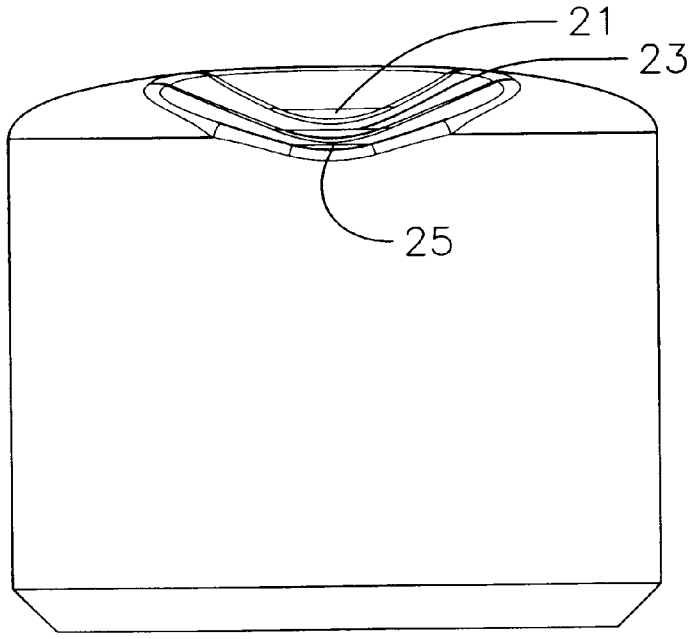
Figure 7A:
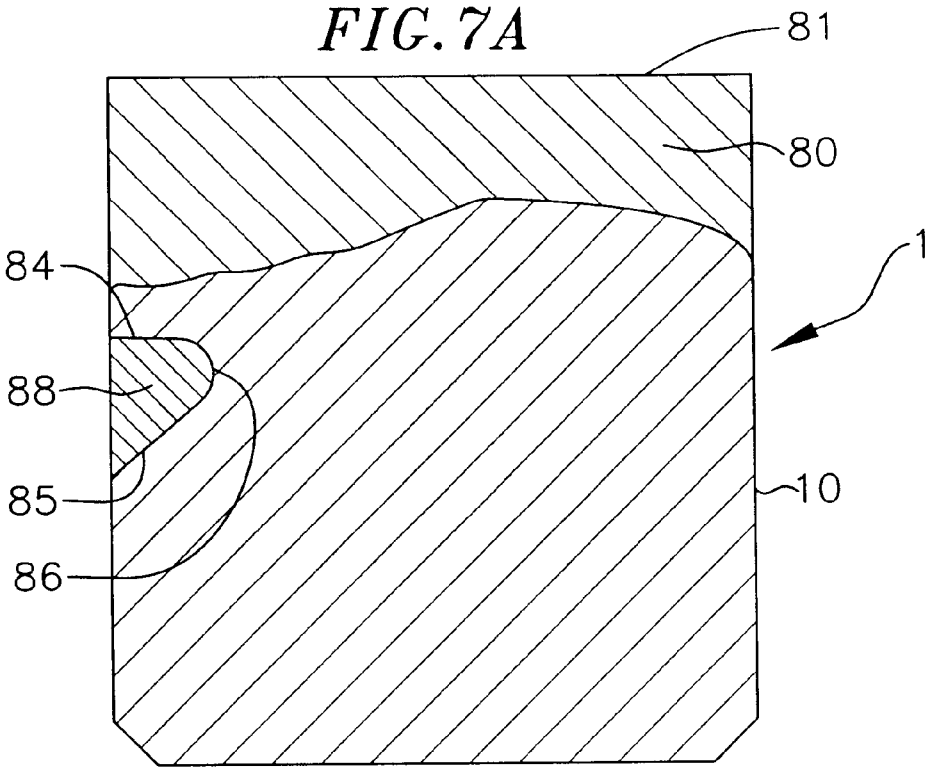
FIG. 7A is a cross-sectional view of an unplanar non-axisymmetric insert of the present invention having a primary cutting surface with a flat upper surface, and having a secondary cutting surface.
Figure 7B:
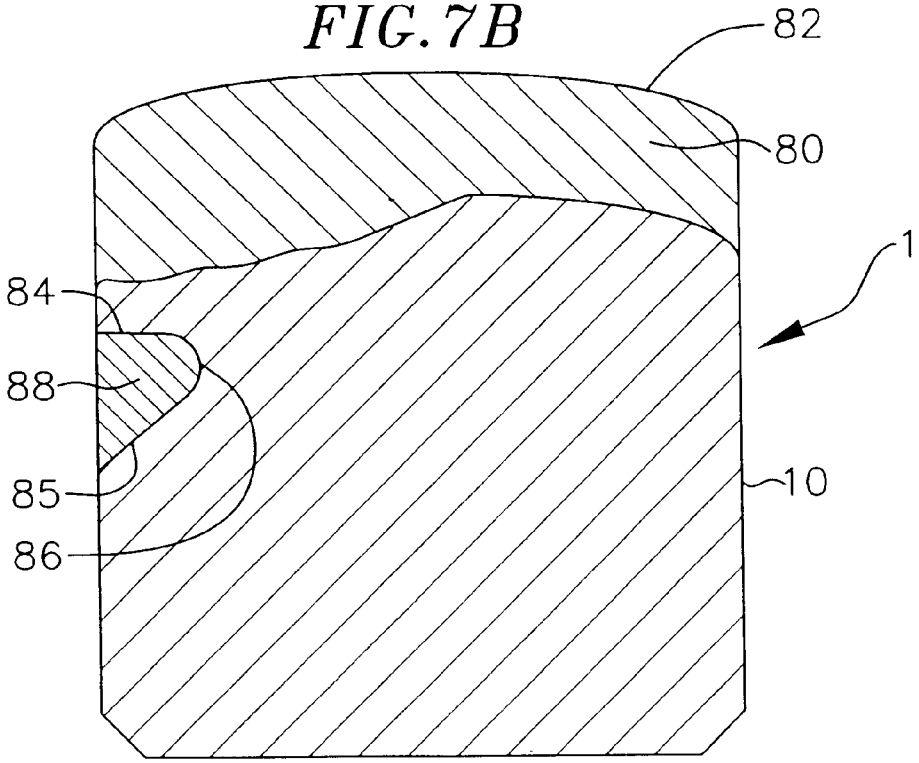
FIG. 7B is a cross-sectional view of an unplanar non-axisymmetric insert of the present invention having a primary cutting surface having a curved upper surface, and having a secondary cutting surface.
Figure 8:
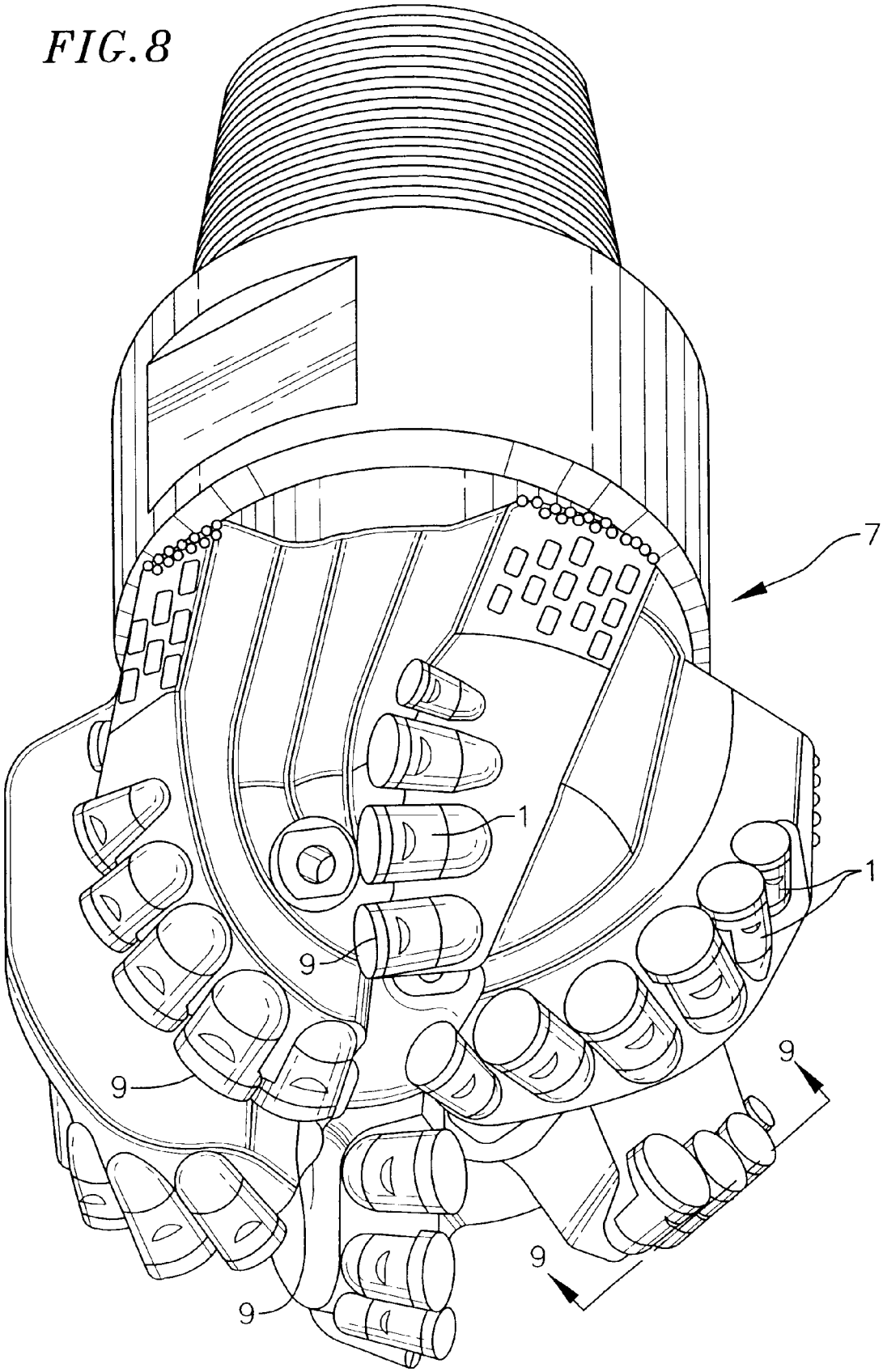
FIG. 8 is a perspective view of a bit body incorporating cutting elements of the present invention.
Figure 9:
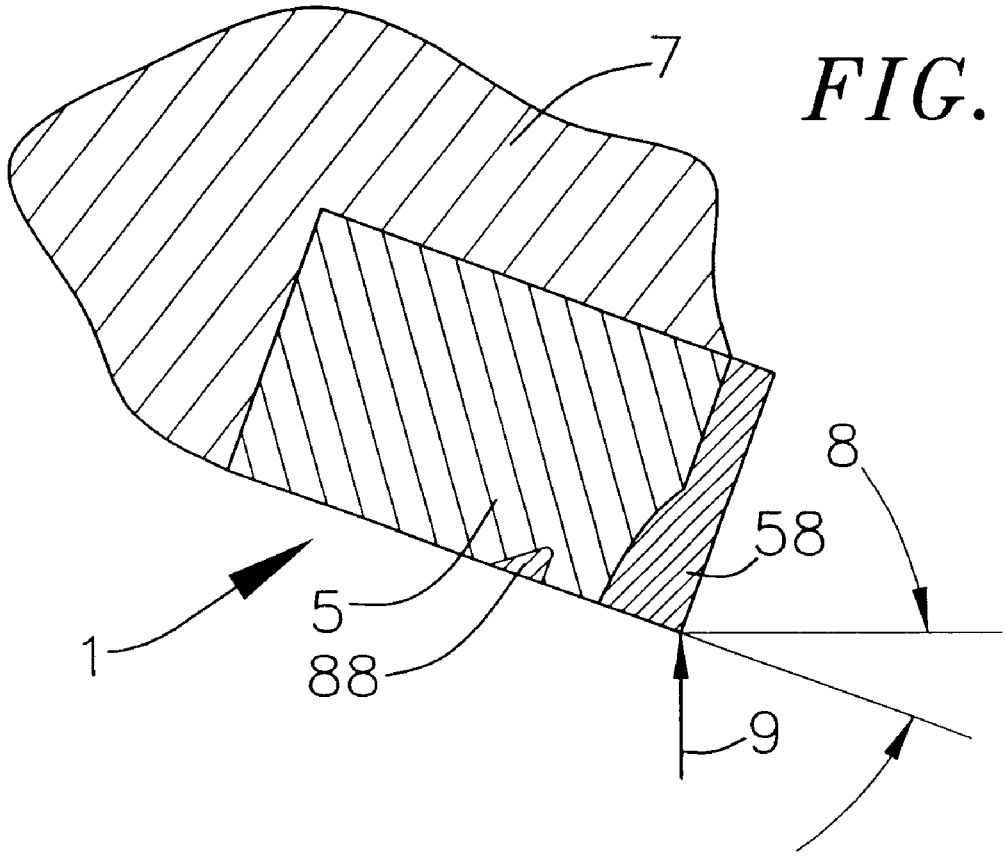
FIG. 9 is a cross-sectional view of a cutting element of the present invention mounted on a bit body.

A present invention cutting element 1 (i.e., insert) has a body (i.e., a substrate) 10 having a curved upper surface 12 (FIGS. 9, 2A and 2B). The body is typically cylindrical. A circumferential edge 14 is formed at the interface of the curved upper surface 12 and the cylindrical outer surface 16 of the body. An ultra hard material layer such a polycrystalline diamond or cubic boron nitride layer 80 is formed on top of the upper surface (FIGS. 7A and 7B). The cutting elements 1 are mounted in a bit body 7 along a rake angle 8 (FIGS. 8 and 9). Consequently, the cutting layer 58 of each cutting element makes contact with the earth formation ideally at an edge point 9 referred to herein as the "cutting layer critical point". Similarly, the point on the body circumferential edge 14 axially below the cutting layer critical point is referred to herein as the "body critical point" 19. To resist cracking, spalling, chipping and partial fracturing, the present invention places an increased thickness of ultra hard material at a region 18 of cutting element which is subjected to the highest impact loads during drilling. This region, referred to herein as the "critical region" includes the body critical point 19. The critical region spans less than 50% of the circular cross-sectional area of the cutting element. Typically, however, the critical region spans an arc of about 45° to 70° on either side of the body critical point 19 and extend radially from the circumference of the cutting element inward to a location at or near the cutting element central axis. A typical critical region 90 is shown bounded by dashed line 92 as shown in FIG. 2C. With the cutting elements of the present invention, the thickness of the ultra hard material cutting layer is increased where it is needed and minimized in other places so as to minimize the risk of cutting layer delamination and/or exfoliation.

To increase the thickness of the ultra hard material layer at the critical region, a main depression 20 is formed within the critical regions at the curved upper surface 12 (i.e., the end face) of the body that interfaces with the cutting ultra hard material cutting layer. The main depression is formed by forming a series of smaller adjacent depressions. For illustrative purposes, these smaller depressions are referred to herein as "secondary depressions". These adjacent secondary depressions can sometimes define steps. The main depression typically spans an arc less than 180° along the substrate upper surface. Preferably, however, the depression spans an arc 22 between 90° and 135° on the body upper surface (FIG. 2B). Because the critical region and the main depression spans only a portion of the insert body upper surface, and because the body upper surface is generally curved the body upper surface is unplanar and non-axisymmetric. Hence the cutting elements of the present invention are referred to as "unplanar non-axisymmetric inserts".

In one embodiment, the main depression is formed by a series of relatively shallow groove-like secondary depressions 21, 23, and 25 (FIGS. 2A–2D). The main depression 20 is ovoidal in shape. The secondary depressions are symmetric about a diameter 29. For descriptive purposes, the diameter is referred to herein as the "critical diameter." The critical diameter is the diameter that intersects the critical point 19. Each depression has a maximum actual depth 32—as measured between the highest and lowest point of the depression—occurring along the critical diameter. Each of the secondary depressions arcuately span the main depression defining scalloped edges 24 and 26 on the main depression as shown in FIG. 2C. Ridges 11 are formed between adjacent secondary depressions. The ridges 11 preferably have rounded apexes 13 to reduce stress concentrations. In this embodiment, the ridges 11 are arcuate curving toward the center of the insert. The curvature or radius of curvature of each ridge decreases for each subsequent radially outward ridge.

The depth 28 of each subsequent secondary depression—as measured from a reference point 30 on the substrate upper surface—is increased in a direction toward the body critical point 19 along the critical diameter 29 as shown in FIG. 2B. In other words, the height of the lowest surface of each subsequent secondary depression as measured from a reference plane 94 perpendicularly intersecting the body decreases radially outward along the critical diameter 29. In this regard, each secondary depression defines a step.

Figure 3A:
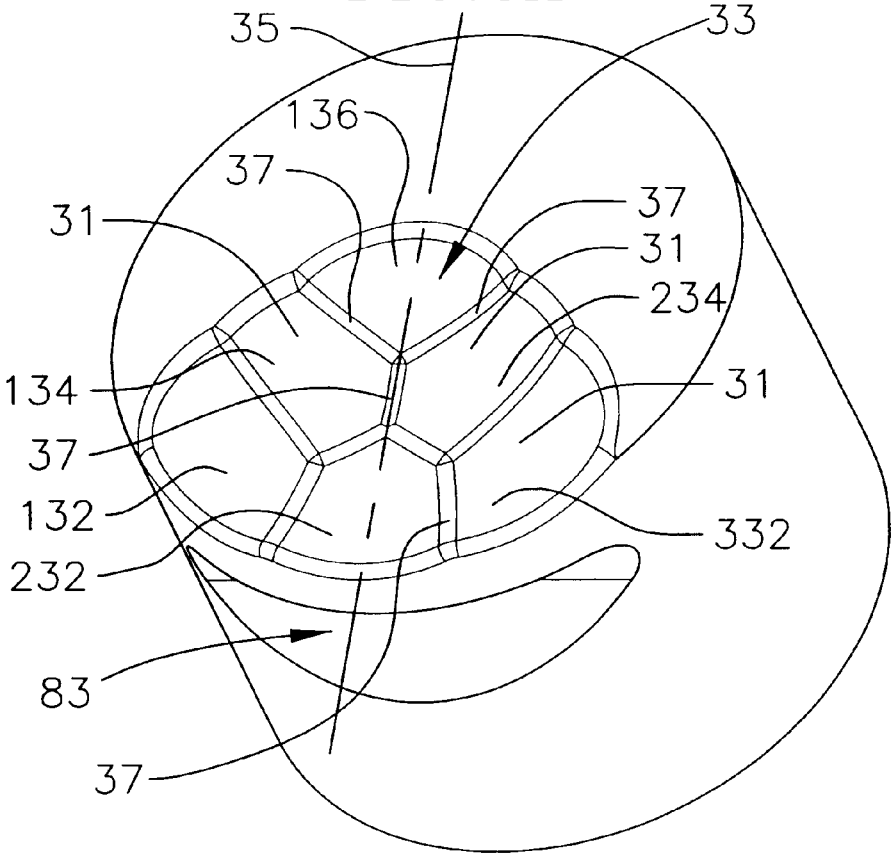
FIG. 3A is a perspective view of the substrate of another embodiment of an unplanar non-axisymmetric insert of the present invention.
Figure 3B:
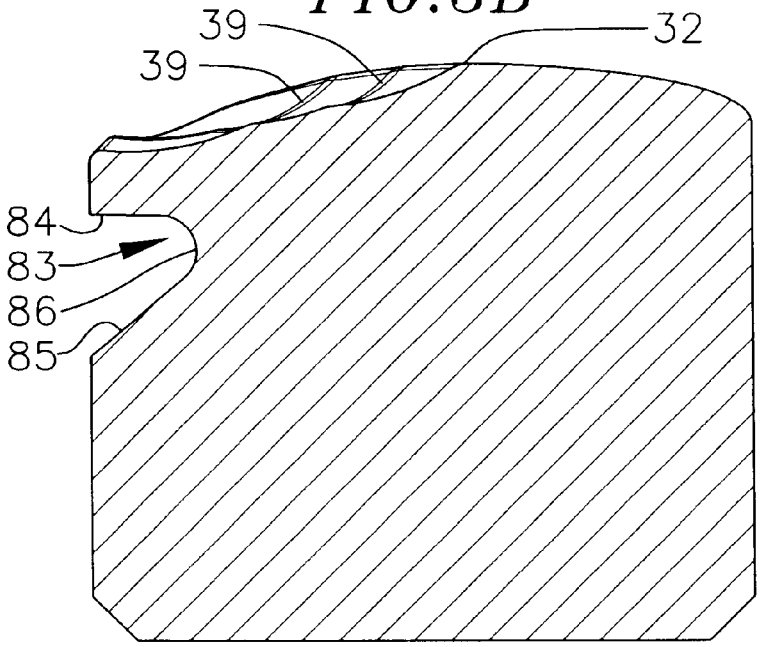
FIG. 3B is a cross-sectional view of the insert body shown in FIG. 3A.

In another embodiment, the main depression 33 is generally triangular in shape (FIG. 3A). With this embodiment, the secondary depressions 31 are arranged in a pyramidal fashion defining a surface resembling the negative of a turtle shell. Three secondary depressions 132, 232, 332 are arranged along the circumferential edge of the insert body upper surface defining a first row of secondary depressions. A second row comprising two secondary depressions 134, 234 is formed adjacent to the first row of secondary depressions. Each of the second row secondary depressions is adjacent to two secondary depressions from the first row. A secondary depression 136 defines a third row. The third row secondary depression 136 is adjacent to both of the second row depressions 134, 234. In a preferred embodiment, the surface defined by the secondary depressions is symmetric about a critical diameter 35 of the insert body. Thus, in the preferred embodiment, the end depressions 132, 332 of the first row are mirror images of each other. Similarly the two second row depressions 134, 234 are also mirror images of each other, whereas the third row depression 136 and the middle depression 232 of the first row are both symmetric about the critical diameter. The maximum depth of the defined surface occurs along the critical diameter 35 with the first row middle depression 232 having a depth as measured from a point 32 on the upper surface of the body that is greater than the depth of the third row depression 136 as measured from the same point. The intersections between consecutive secondary depressions form ridges 37 which have preferably rounded apexes 39 so as to reduce stress concentrations (FIG. 3B).

Figure 4A:
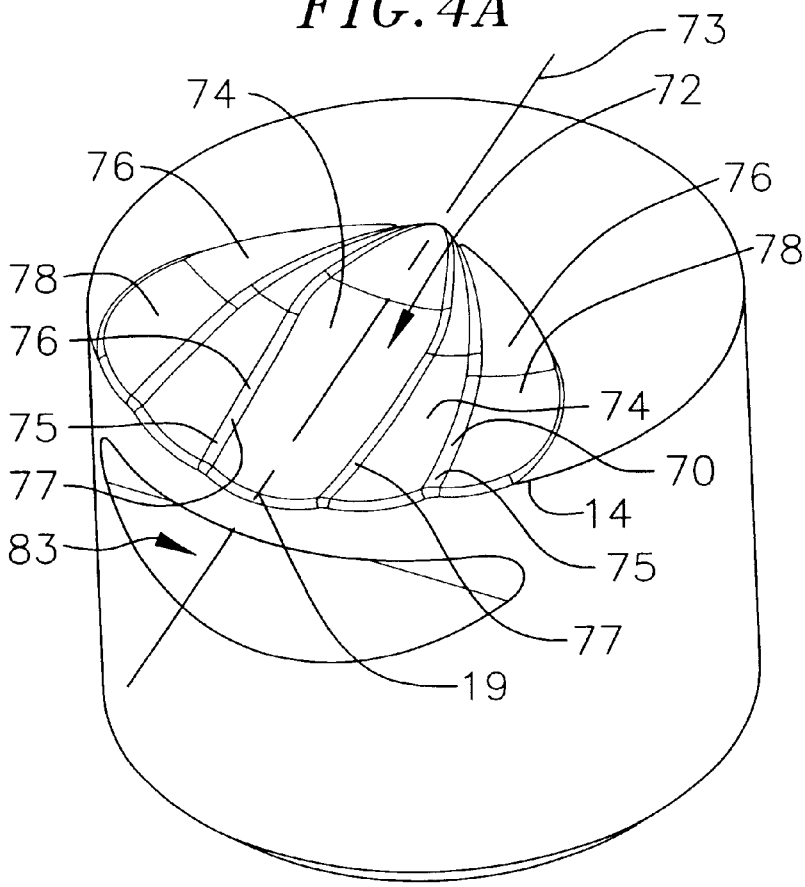
FIG. 4A is a perspective view of the substrate of another embodiment of an unplanar non-axisymmetric insert of the present invention.
Figure 4B:
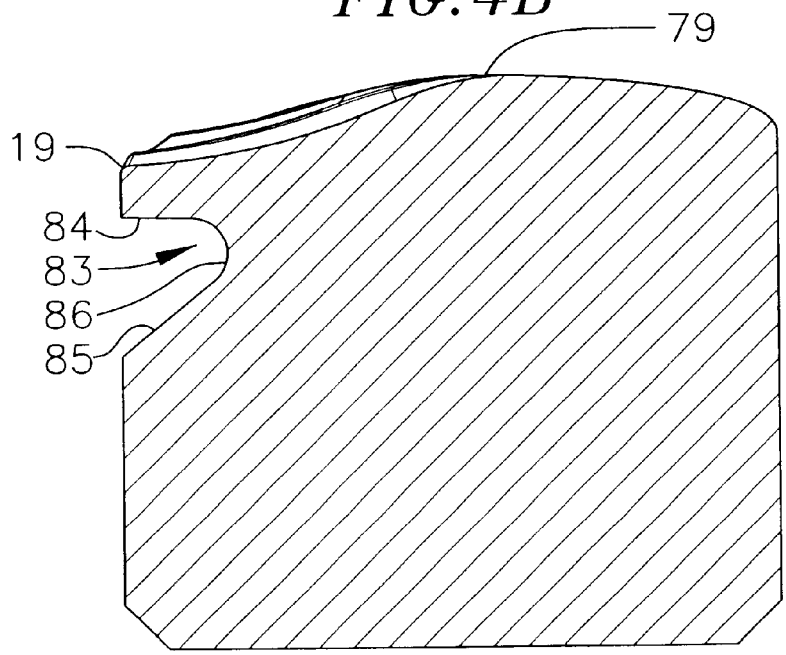
FIG. 4B is a cross-sectional view of the insert body shown in FIG. 4A.

In another embodiment, the main depression 72 is formed by a series of generally radial secondary depressions 74 which preferably increase in depth—as measured from a reference point 79 on the substrate upper surface—in a direction toward the body circumferential edge 14 (FIGS. 4A and 4B). These depressions may be shaped and arranged to define a main depression surface that resembles the inner surface of a shell or that resembles a fan, as shown in FIG. 4A. Ridges 75 with preferably rounded apexes 77 are formed between adjacent secondary depressions. The main depression surface defined by the secondary depressions is symmetric about a critical diameter 73 of the insert body. Moreover, the maximum depth of the surface defined by the secondary depressions—as measured from a reference point 79 on the upper surface of the insert body—occurs at the body critical point 19. Furthermore, the maximum depth of each secondary depression decreases for depressions further away from the diameter. In addition, each radial secondary depression may itself consist of multiple steps or depressions, as for example steps 76 and 78 shown in FIG. 4A.

Figure 5A:
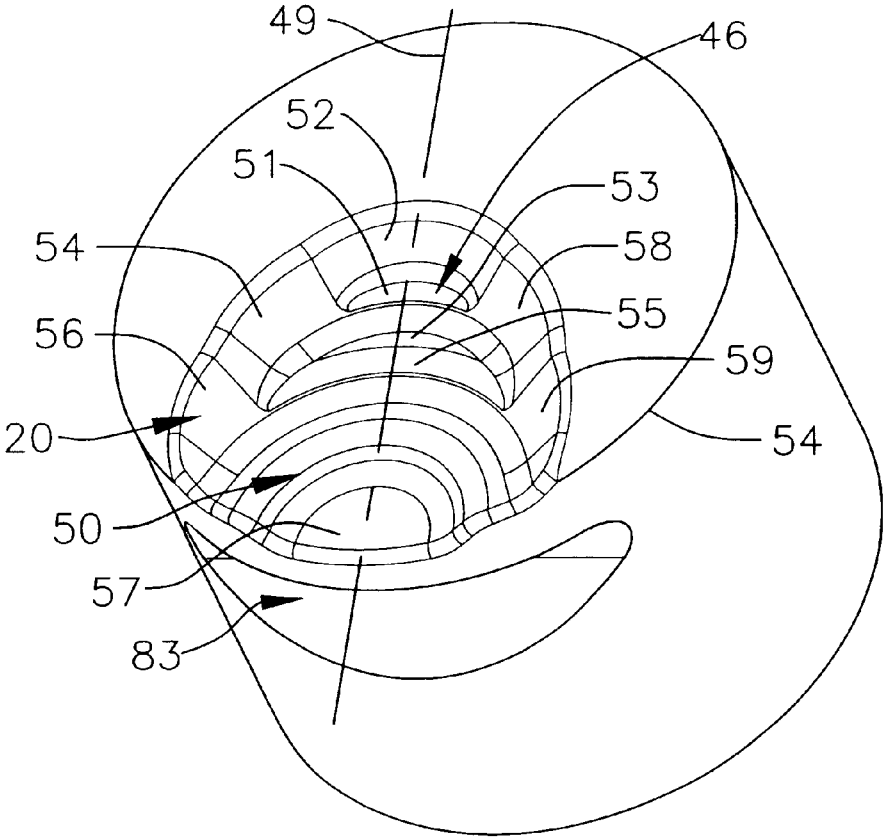
FIG. 5A is a perspective view of yet a further embodiment of the substrate of an unplanar non-axisymmetric insert of the present invention.
Figure 5B:
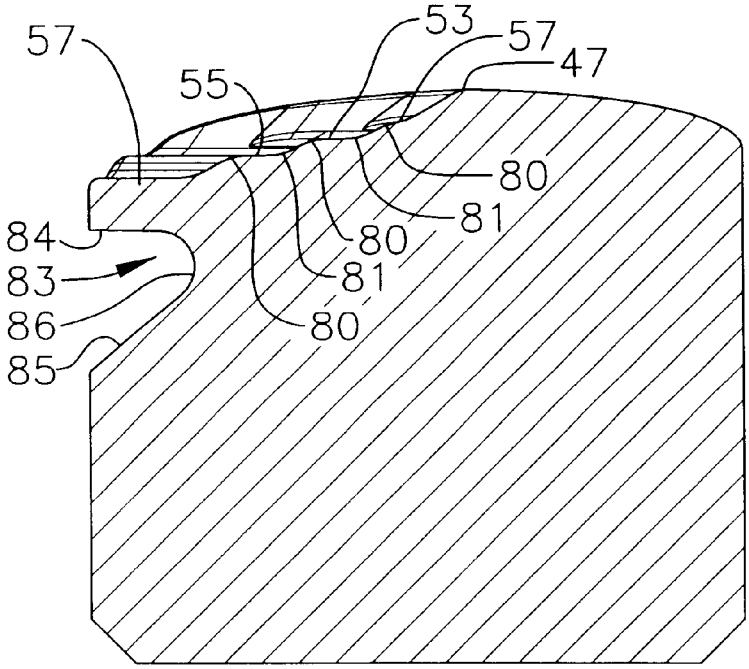
FIG. 5B is a cross-sectional view of the insert body shown in FIG. 5A.

In yet another embodiment, the secondary depressions forming the main depression 50 comprise steps and concave walls. The steps and walls formed are arranged in a shape resembling a terrace or an amphitheater 46 which is symmetric about a critical diameter 49 as shown in FIGS. 5A and 5B. In this embodiment, of a series of arcuate steps 51, 53, 55, and 57 define the central part of the main depression as shown in FIGS. 5A and 5B. These steps define arcuate depressions which curve toward the body critical point 19. The radius of curvature decreases for each subsequent radially outward arcuate step. The edges 80 of these steps and the edges 81 between steps are rounded to reduce stress concentration. A series of concave walls 52, 54, 56, 58 and 59 surround the arcuate depressions and to the periphery of the main depression 50. The maximum depth of each depression—as measured from a reference point 47 on the substrate upper surface—increases in a radially outward direction along the critical diameter 49. Moreover, the maximum depth of each depression occurs along the critical diameter 49.

Figure 6A:
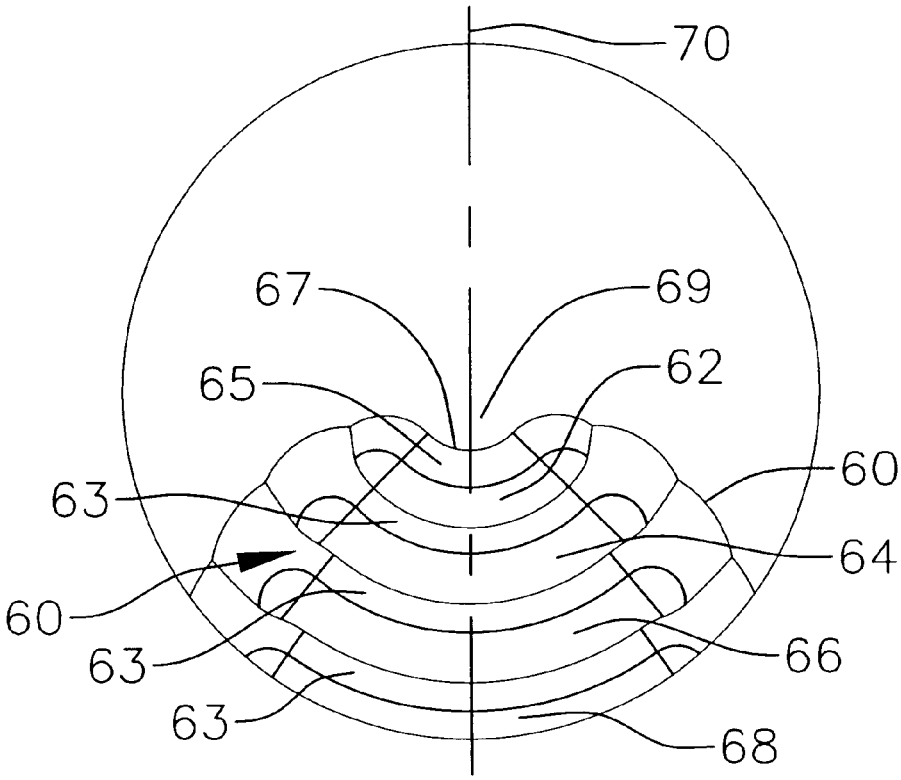
FIG. 6A is a top view of another embodiment of the substrate of an unplanar non-axisymmetric insert of the present invention.
Figure 6B:
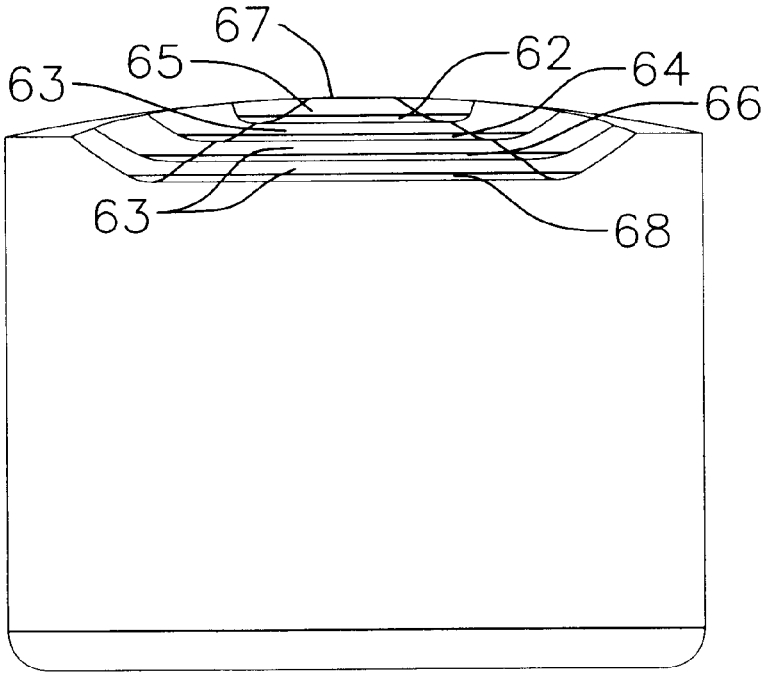
FIG. 6B is a front view of the insert body shown in FIG. 6A.

In a further embodiment, the secondary depressions forming the main depression 60 comprise arcuate concave walls 63 and 65 and a series of arcuate steps 62, 64, 66 and 68 (FIGS. 6A and 6B). These steps define arcuate depressions which curve toward the center of the cutting element body. Each step is relatively flat. The radius of curvature decreases for each subsequent radially inward step. The main depression 60 does not extend to the central axis 69 of the cutting element. Arcuate concave walls interconnect the subsequent steps and extend to the peripheral edges of the main depression 60. An arcuate concave wall 65 bounds the step 62 closest to the insert central axis. An edge 67 of the concave wall 65 curves around the central axis 69 of the substrate. The steps and walls are symmetric about a critical diameter 70. Moreover the depth of each subsequent step—as measured from a reference point on the upper surface of the body—increases for each subsequent radially outward step.

With all of the aforementioned embodiments, the periphery of the main depression which is defined by the secondary depressions, steps or walls, is scalloped. Moreover, the ultra hard material layer 58 bonded to the upper surface of the substrate may have a flat upper surface 81 (FIG. 7A) or may have a convexly curved or dome-shaped upper surface 82 (FIG. 7B), while the layer lower surface which interfaces with the substrate upper surface is complementary to the substrate upper surface. As such, an ultra hard material cutting layer is formed on top of the substrate having increased thickness at the critical region and a maximum thickness at the critical point of the cutting layer that will make contact with the earth formations during drilling. In an exemplary embodiment, the maximum thickness of the ultra hard material cutting layer is in the range of 0.08 to 0.2 inch. The minimum thickness of the ultra hard material layer is preferably in the range of 0.06 to 0.08 inch.

In all of the aforementioned embodiments, the multiple secondary depressions used to define the main depression provide for an non-planar interface between diamond cutting layer and the substrate in the critical region. This non-planar main depression provides for a larger bonding area between the ultra hard material and the body so as to reduce the stress levels at the interface which cause delamination. Consequently, a thicker ultra hard material cutting layer portion may be bonded at the critical region without increasing the risk of delamination of the cutting layer.

In alternate embodiments, more than one main depression is formed on the substrate upper surface. In this regard, as the ultra hard material layer wears due to drilling, the cutting element can be detached, rotated and re-attached to the bit body so as to orient another main depression on the critical region of the cutting element. In this regard, the cutting element can be used again.

Figure 10A:
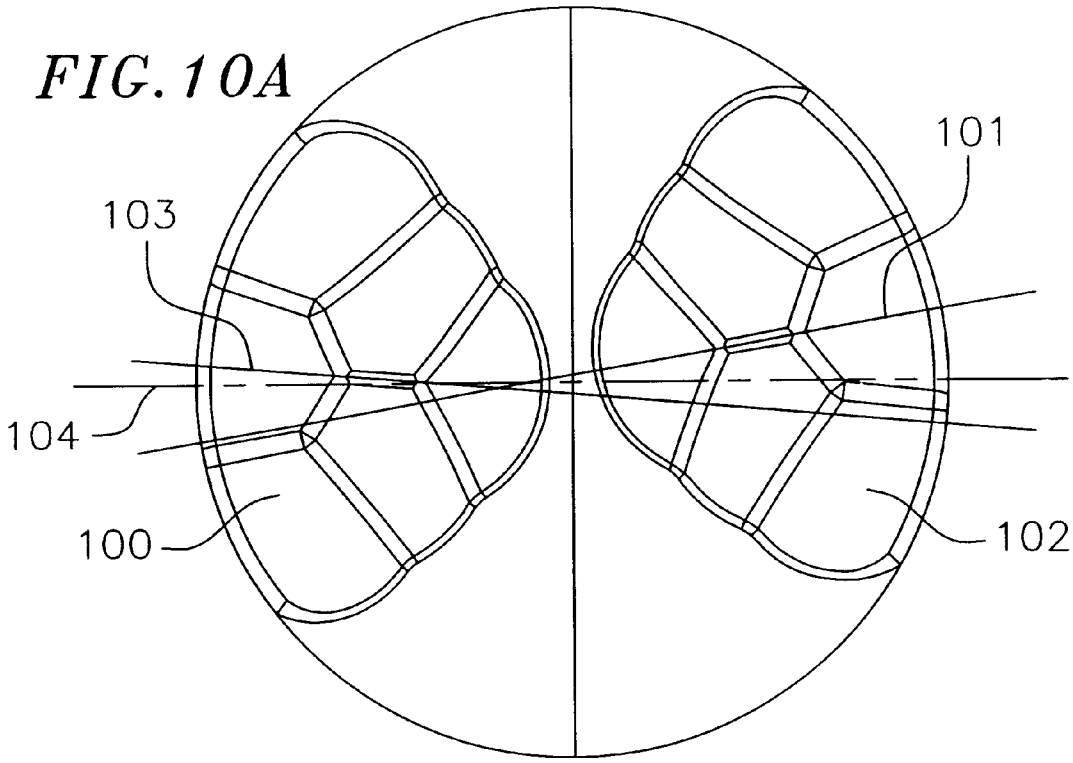
FIG. 10A is a top view of the substrate of another embodiment of an unplanar non-axisymmetric insert of the present invention comprising two main depressions.

In one alternate embodiment, a cutting element is formed with two main depressions. The two main depressions 100 and 102 are oriented such that their central longitudinal axes 101 and 103, respectively, form an angle relative to each other that is less than 180° but greater than 170° as for example, shown in FIG. 10A. In this regard, the two main depressions are not aligned directly behind each other.

By offsetting the main depressions at an angle of less than 180° , the second main depression oriented away from the critical zone will not have its central longitudinal axis 101 aligned with the critical diameter 104 and consequently the residual stress distribution generated on the substrate end surface having the depressions will not be symmetric. Testing has revealed that the impact strength of cutting elements with non-symmetric stress distributions on their substrate end surfaces interfacing with the ultra hard material layers is greater than the impact strength of cutting elements having symmetric stress distributions on their substrate end surfaces. Consequently, by offsetting the main depression from the second main depression, the impact strength of the cutting elements should be improved.

Figure 10B:
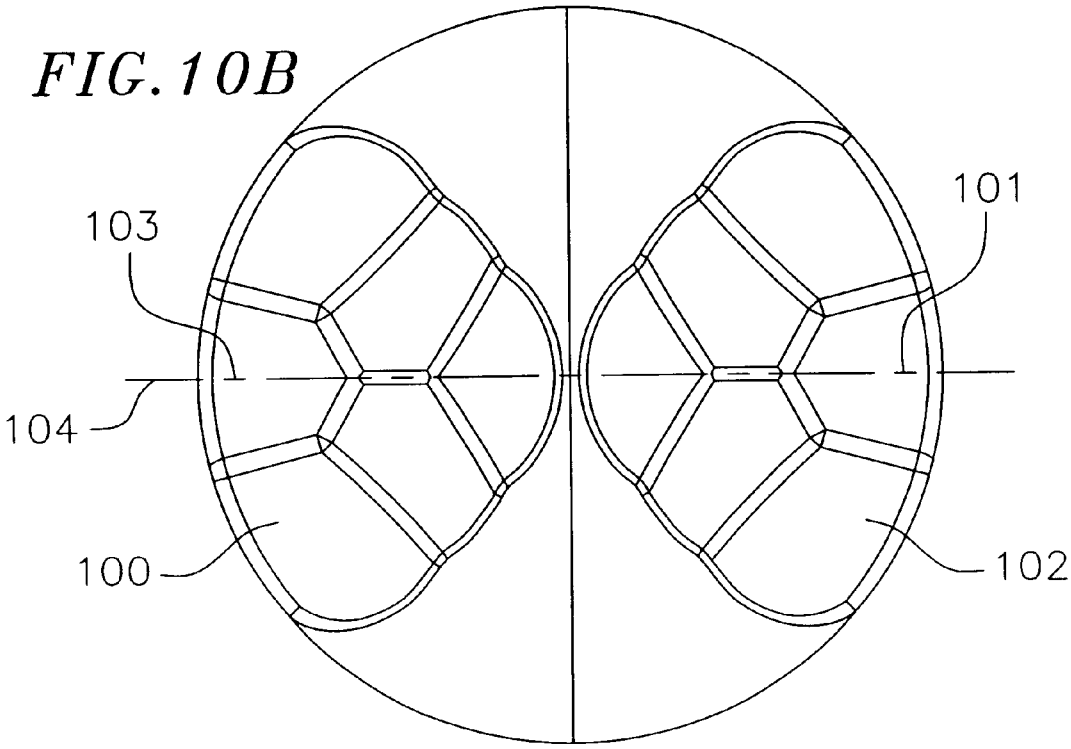
FIG. 10B is a top view of the substrate of a further embodiment of an unplanar non-axisymmetric insert of the present invention comprising two main depressions.
Figure 11:
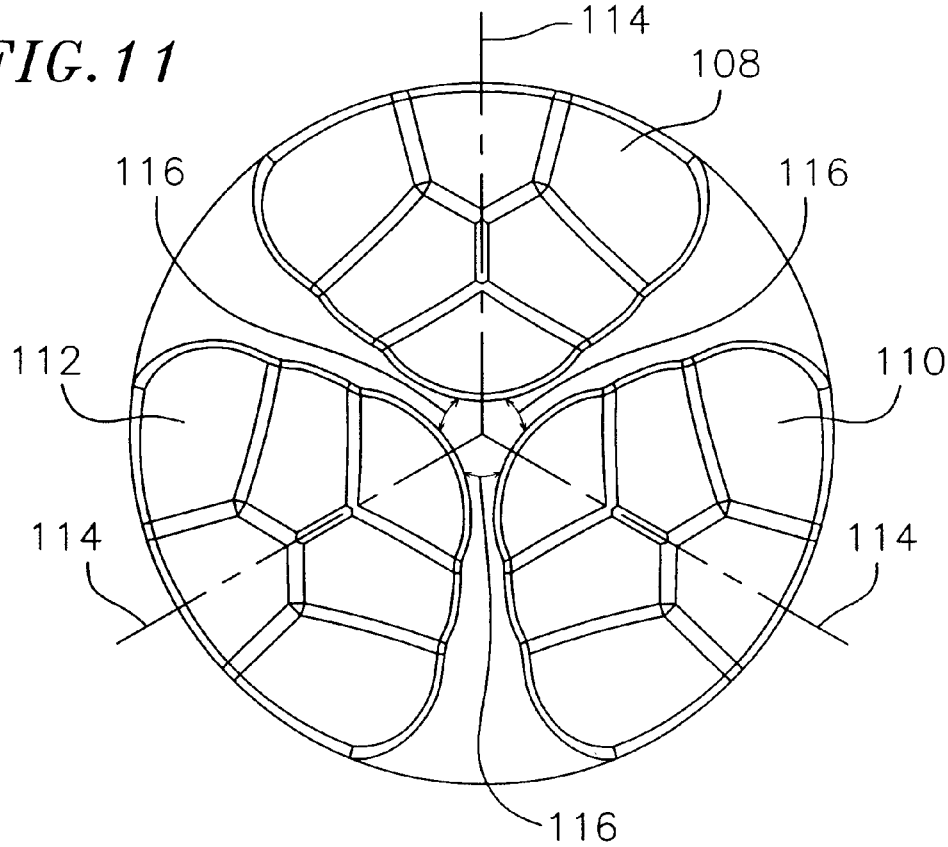
FIG. 11 is a top view of the substrate of another embodiment of an unplanar non-axisymmetric insert of the present invention comprising three main depressions.

In another embodiment, two main depressions may used such that their central longitudinal axes 101 and 103 are oriented at 180° to each other as shown in FIG. 10B. In a further alternate embodiment, three main depressions 108, 110 and 112 are formed on the upper surface of the substrate such that their central longitudinal axes 114 are spaced apart and oriented at an angle 116 of preferably 120° to each other as for example shown in FIG. 11. Alternatively, the spacing between the longitudinal axes of any two consecutive main depressions may be greater or smaller than 120° and may be limited by the size of the main depressions.

Figure 12:
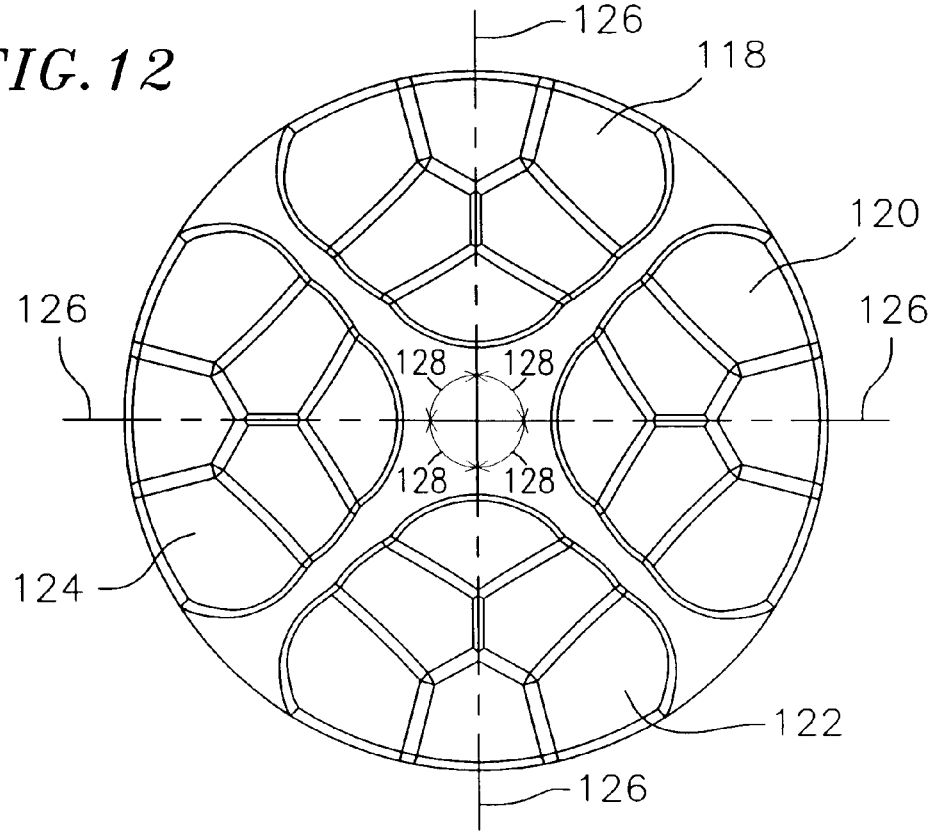
FIG. 12 is a top view of the substrate of another embodiment of an unplanar non-axisymmetric insert of the present invention comprising four main depressions.

In a further alternate embodiment, four main depressions 118, 120, 122, and 124 are formed as for example shown in FIG. 12. Preferably, with this embodiment the longitudinal central axes 126 of the four main depressions are spaced apart and oriented at an angle 128 of 90° to each other. Alternatively, the spacing between the longitudinal axes of any two consecutive main depressions may be greater or smaller than 90° and may be limited by the size of the main depressions.

Figure 13:
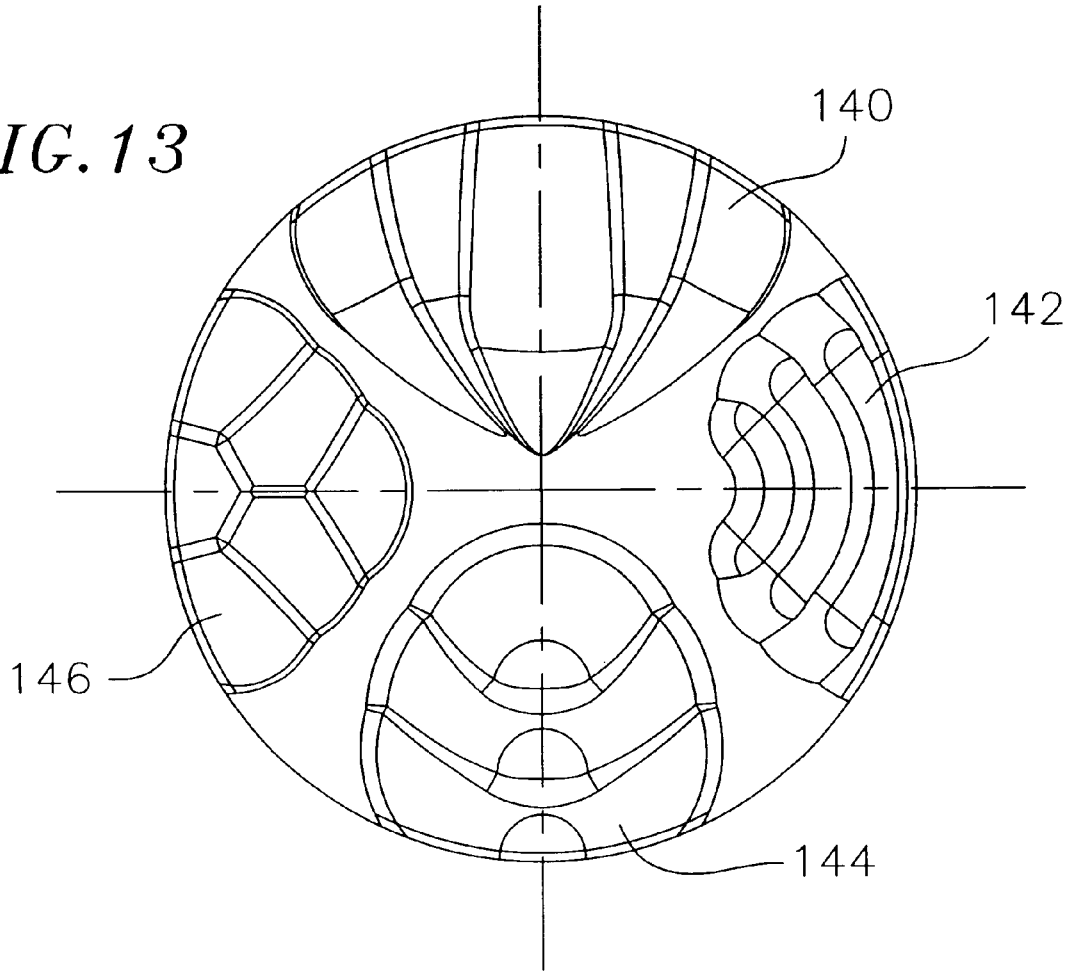
FIG. 13 is a top view of the substrate of a further embodiment of an unplanar non-axisymmetric insert of the present invention comprising four main depressions.

While the multiple main depressions formed on the end surface of the substrate may be identical, as for example shown in FIGS. 10A, 10B, 11 and 12, such that the cutting element can be rotated on the bit body and re-used, the cutting element body may be formed with one or more different main depressions, as for example the four main depressions 140, 142, 144 and 146 shown in FIG. 13, such that a cutting element manufacturer may manufacture a single cutting element that may be used for different cutting tasks by changing its orientation when mounted on a bit body. With any of the embodiments incorporating more than one main depression, the depressions can have the geometry of any of the main depressions described herein.

Furthermore, with any of these embodiments, a circumferential groove 83 may be formed on the cylindrical outer surface of the substrate in a location below the depression (FIGS. 3A, 3B, 4A, 4B, 5A, 5B, 7A, and 7B). Preferably, the groove spans an arc equal or slightly greater than the arc 22 span by the main depression on the upper surface of the substrate. In cross-section, preferably the groove has a horizontal upper side wall 84 and a slanted lower side wall 85 with a round bottom 86 therebetween. The slanted lower side wall slants in the direction opening the groove. The circumferential groove is preferably symmetric about a plane through the critical diameter. Applicant has discovered that the geometry of this groove reduces the level of the stresses generated at and around the groove. Moreover, the slanted wall of the groove provides for a groove geometry that is easier to pack with ultra hard material, thereby making the manufacture of the cutting element easier and less costly.

Ultra hard material is bonded into the circumferential groove forming a secondary cutting surface 88. This secondary cutting surface serves two purposes. First it serves as an additional cutting surface, increasing the cutting efficiencies of the cutting element. Second, it delays the erosion and wear of the cutting element body that occurs when the cutting element body is allowed to make contact with the earth formation during drilling.

All the depressions and grooves disclosed herein may be formed by any of the well known substrate fabrication methods. For example, a cylindrical electrode blank having an end surface is formed using any of well known electrode blank forming methods and materials and the depressions are milled on the blank end surface. A typical electrode blank for example may be made from copper or graphite. The milled blank end surface has the shape of the desired substrate end surface with the desired depressions. The milled blank is then used to form a dye complementary to the blank which serves as a negative for forming the desired substrate having a shape complementary to the dye. Forming the dye may be accomplished by plunging the milled electrode blank into the dye material. The electrode blank serves as a cathode while the dye material serves as the anode. As the milled electrode blank is moved closer to the dye during plunging, the dye material erodes away forming a negative of the blank in the dye material, i.e., forming a dye. The substrate is formed using the dye using any of the well known methods, e.g., sintering of carbide powder.

With any of the above referenced embodiment, a transition layer may be incorporated with between the substrate and the ultra hard material cutting layer. The transition layer may have properties intermediate between the properties of the substrate and the ultra hard material layer. The depressions disclosed herein may be formed directly on the transition layer, on the substrate end surface, or both. If the depressions are formed on a substrate end surface, the transition layer may be draped over the end surface for defining corresponding depressions on the transition layer end surface. More than one transition layers may be incorporated. For convenience, the term "body" as used herein in relation to a cutting element should be interpreted broadly include the substrate and also any transition layers.

All of the inserts of the present invention are mounted in a bit body 7 and are oriented such that the critical region of each insert is positioned to engage the earth's formation at the critical point 9 of the cutting layer which will make contact with the earth formation during drilling (FIGS. 8 and 9). In this regard, the region of high impact loading during cutting will have the thickest section of ultra hard material. Moreover, by doing so, the secondary cutting surface will also be aligned to eventually contact the earth formation and increases cutting efficiency as well as delay the erosion and wear of the cutting element.

Although the present invention has been described and illustrated to respect to multiple embodiments thereof, it is to be understood that it is not to be so limited, since changes and modifications may be made therein which are within the full intended scope of this invention as hereinafter claimed.

What is claimed is:

1. A cutting element comprising:

a cylindrical body comprising an end face having a periphery;

a first set of abutting secondary depressions formed on the end face defining a first main depression, wherein the first main depression spans less than half of the end face and extends to the periphery;

a first set of ridges formed at the intersection between the first set of abutting secondary depressions wherein at least portions of the ridges of the first set are depressed relative to the end face;

a second set of abutting secondary depressions formed on the end face defining a second main depression, wherein the second main depression spans less than half of the end face and extends to the periphery;

a second set of ridges formed at the intersection between the second set of abutting secondary depressions wherein at least portions of the ridges of the second set are depressed relative to the end face;

an ultra hard material layer formed over the end face, wherein the thickness of the ultra hard material layer is greatest at the periphery of the end face above the first main depression.

2. A cutting element as recited in claim 1 wherein the end face is convexly curved.

3. A cutting element as recited in claim 1 wherein the first main depression is spaced apart from the second main depression.

4. A cutting element as recited in claim 1 wherein the first main depression comprises a central longitudinal axis, wherein the second main depression comprises a central longitudinal axis, wherein the central longitudinal axis of the second main depression is offset from the central longitudinal axis of the first main depression by an angle of 180° .

5. A cutting element as recited in claim 1 wherein the first main depression comprises a central longitudinal axis, wherein the second main depression comprises a central longitudinal axis, wherein the central longitudinal axis of the second main depression is offset from the central longitudinal axis of the first main depression by an angle less than 180°.

6. A cutting element as recited in claim 5 wherein the central longitudinal axis of the second main depression is offset from the central longitudinal axis of the first main depression by an angle not greater than 170°.

7. A cutting element as recited in claim 1 wherein the first set of abutting depressions are arranged to define a first pattern within the first main depression, wherein the second set of abutting depressions are arranged to define a second pattern within the second main depression, wherein the first pattern is different from the second pattern.

8. A cutting element as recited in claim 1 wherein the first set of abutting depressions are arranged to define a first pattern within the first main depression, wherein the second set of abutting depressions are arranged to define a second pattern within the second main depression, wherein the first pattern is the same as the second pattern.

9. A cutting element as recited in claim 1 further comprising:

a third set of abutting secondary depressions formed on the end face defining a third main depression, wherein the third main depression extends to the periphery; and a third set of ridges formed at the intersection between the third set of abutting secondary depressions wherein at least portions of the ridges of the third set are depressed relative to the end face.

10. A cutting element as recited in claim 9 wherein the first main depression comprises a central longitudinal axis, wherein the second main depression comprises a central longitudinal axis, wherein the third main depression comprises a central longitudinal axis and wherein the three axes are offset at an angle of 120° from each other.

11. A cutting element as recited in claim 9 further comprising:

a fourth set of abutting secondary depressions formed on the end face defining a fourth main depression, wherein the fourth main depression extends to the periphery; and a fourth set of ridges formed at the intersection between the fourth set of abutting secondary depressions wherein at least portions of the ridges of the fourth set are depressed relative to the end face.

12. A cutting element as recited in claim 11 wherein the first main depression comprises a central longitudinal axis, wherein the second main depression comprises a central longitudinal axis, wherein the third main depression comprises a central longitudinal axis, wherein the fourth main depression comprises a central longitudinal axis, and wherein the four central longitudinal axes are offset at an angle of 90° from each other.

13. A cutting element as recited in claim 1 wherein the first main depression comprises a periphery, wherein the second main depression comprises a periphery, and wherein a portion of each of the first and second main depression peripheries are scalloped.

14. A cutting element as recited in claim 1 wherein the ridges of the first and second set comprise rounded apexes.

15. A cutting element as recited in claim 1 wherein at least some of the first set abutting secondary depressions intersect a first diameter of the end face, wherein one of said at least some first set abutting secondary depressions extends to the body periphery, wherein at least some of the second set abutting secondary depressions intersect a second diameter of the end face, wherein one of said at least some of second set abutting secondary depressions extends to the body periphery.

16. A cutting element as recited in claim 15 wherein the first set ridges comprise apexes intersecting the first diameter, wherein the second set of ridges comprise apexes intersecting the second diameter, each of the first set ridge apexes intersecting the first diameter at a different height level as measured from a plane perpendicularly intersecting a central axis of the body, wherein said first set ridge apex height levels decrease radially outward toward the body periphery, and wherein each of the second set ridge apexes intersecting the second diameter at a different height level as measured from a plane perpendicularly intersecting the central axis of the body, wherein said second set ridge apex height levels decrease radially outward toward the body periphery.

17. A cutting element as recited in claim 15 wherein each of the first set secondary depressions extends to a minimum height level as measured from a plane perpendicularly intersecting a central axis of the body, wherein each of the first set secondary depressions minimum height level decreases arcuately away from said first diameter, and wherein each of the second set secondary depressions extends to a minimum height level as measured from a plane perpendicularly intersecting the central axis of the body, wherein each of the second set secondary depressions minimum height level decreases arcuately away from said second diameter.

18. A cutting element as recited in claim 15 wherein the first main depression is symmetric about the first diameter and wherein the second main depression is symmetric about the second diameter.

19. A cutting element as recited in claim 15 wherein the first diameter is the same as the second diameter.

20. A cutting element as recited in claim 15 wherein the first diameter is different from the second diameter.

* * * * *